US011640128B2

(12) United States Patent
Shimojima et al.

(10) Patent No.: US 11,640,128 B2
(45) Date of Patent: May 2, 2023

(54) LIQUID DISCHARGE HEAD, LIQUID DISCHARGE DEVICE, AND LIQUID DISCHARGE APPARATUS

(71) Applicants: Kazuhiro Shimojima, Ibaraki (JP); Kenji Nozawa, Ibaraki (JP); Genichiroh Kawamichi, Ibaraki (JP); Masato Ogawa, Kanagawa (JP); Kohki Asada, Tokyo (JP); Kazuaki Kamihara, Tokyo (JP); Hiroshi Sawase, Kanagawa (JP); Ryusaku Hida, Kanagawa (JP)

(72) Inventors: Kazuhiro Shimojima, Ibaraki (JP); Kenji Nozawa, Ibaraki (JP); Genichiroh Kawamichi, Ibaraki (JP); Masato Ogawa, Kanagawa (JP); Kohki Asada, Tokyo (JP); Kazuaki Kamihara, Tokyo (JP); Hiroshi Sawase, Kanagawa (JP); Ryusaku Hida, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 17/404,804

(22) Filed: Aug. 17, 2021

(65) Prior Publication Data

US 2022/0066361 A1 Mar. 3, 2022

(30) Foreign Application Priority Data

Sep. 2, 2020 (JP) ..... JP2020-147262

(51) Int. Cl.
*G03G 15/20* (2006.01)

(52) U.S. Cl.
CPC ..... *G03G 15/2028* (2013.01)

(58) Field of Classification Search
CPC ..... G03G 15/2028
See application file for complete search history.

(56) References Cited

U.S. PATENT DOCUMENTS

| | | | | |
|---|---|---|---|---|
| 5,802,444 | A | 9/1998 | Takeuchi et al. | |
| 6,108,514 | A * | 8/2000 | Nakayama | G03G 15/657 399/400 |
| 2007/0165092 | A1 | 7/2007 | Kito | |
| 2008/0101818 | A1 | 5/2008 | Shimojima et al. | |
| 2013/0180187 | A1 | 7/2013 | Takeshita et al. | |
| 2015/0253699 | A1 | 9/2015 | Shimojima et al. | |
| 2017/0242370 | A1 | 8/2017 | Takenaga et al. | |

(Continued)

FOREIGN PATENT DOCUMENTS

| | | |
|---|---|---|
| JP | H02261746 A | 10/1990 |
| JP | 6-144677 | 5/1994 |

(Continued)

OTHER PUBLICATIONS

JP_02261746_A_I MachineTranslation, Japan, Takemura, 1990.*

(Continued)

*Primary Examiner* — Victor Verbitsky
(74) *Attorney, Agent, or Firm* — Duft & Bornsen, PC

(57) ABSTRACT

A sheet conveyor includes a conveyance belt configured to rotate to convey a sheet on which a liquid has been applied in a conveyance direction, and a guide configured to guide the sheet to the conveyance belt, a position of the guide being variable in the conveyance direction.

20 Claims, 9 Drawing Sheets

(56) References Cited

U.S. PATENT DOCUMENTS

| | | | |
|---|---|---|---|
| 2017/0253453 | A1 | 9/2017 | Vos et al. |
| 2021/0053370 | A1 | 2/2021 | Numata |
| 2021/0138807 | A1 | 5/2021 | Shimojima et al. |

FOREIGN PATENT DOCUMENTS

| | | | |
|---|---|---|---|
| JP | 2003021941 | A | 1/2003 |
| JP | 2008-162035 | | 7/2008 |
| JP | 2010-002644 | | 1/2010 |
| JP | 2019-151455 | | 9/2019 |
| JP | 2021-035761 | | 3/2021 |

OTHER PUBLICATIONS

JP_2003021941_A_T MachineTranslation, Japan, Mikita, 2003.*
European Search Report; Application EP21193012; dated Feb. 7, 2022.

* cited by examiner

LIQUID DISCHARGE HEAD, LIQUID DISCHARGE DEVICE, AND LIQUID DISCHARGE APPARATUS

CROSS-REFERENCE TO RELATED APPLICATION

This patent application is based on and claims priority pursuant to 35 U.S.C. § 119(a) to Japanese Patent Application No. 2020-147262, filed on Sep. 2, 2020, in the Japan Patent Office, the entire disclosures of which is hereby incorporated by reference herein.

BACKGROUND

Technical Field

Aspects of the present disclosure relate to a sheet conveyor, a sheet heater, a liquid discharge apparatus, and a printer.

Related Art

A printer applies a liquid onto a print target (liquid application target) such as a sheet. The printer includes a heater to heat the sheet on which the liquid has been applied to accelerate drying of the liquid applied on the sheet conveyed by a conveyance belt.

SUMMARY

In an aspect of this disclosure, a sheet conveyor includes a conveyance belt configured to rotate to convey a sheet on which a liquid has been applied in a conveyance direction, and a guide configured to guide the sheet to the conveyance belt, a position of the guide being variable in the conveyance direction.

In another aspect of this disclosure, a sheet conveyor includes a conveyance belt configured to rotate to convey a sheet on which a liquid has been applied in a conveyance direction, and a downstream guide disposed downstream of the conveyance belt, the downstream guide configured to receive the sheet from the conveyance belt, a position of the downstream guide being variable in the conveyance direction.

BRIEF DESCRIPTION OF THE SEVERAL VIEWS OF THE DRAWINGS

The aforementioned and other aspects, features, and advantages of the present disclosure will be better understood by reference to the following detailed description when considered in connection with the accompanying drawings, wherein.

Figure 1:
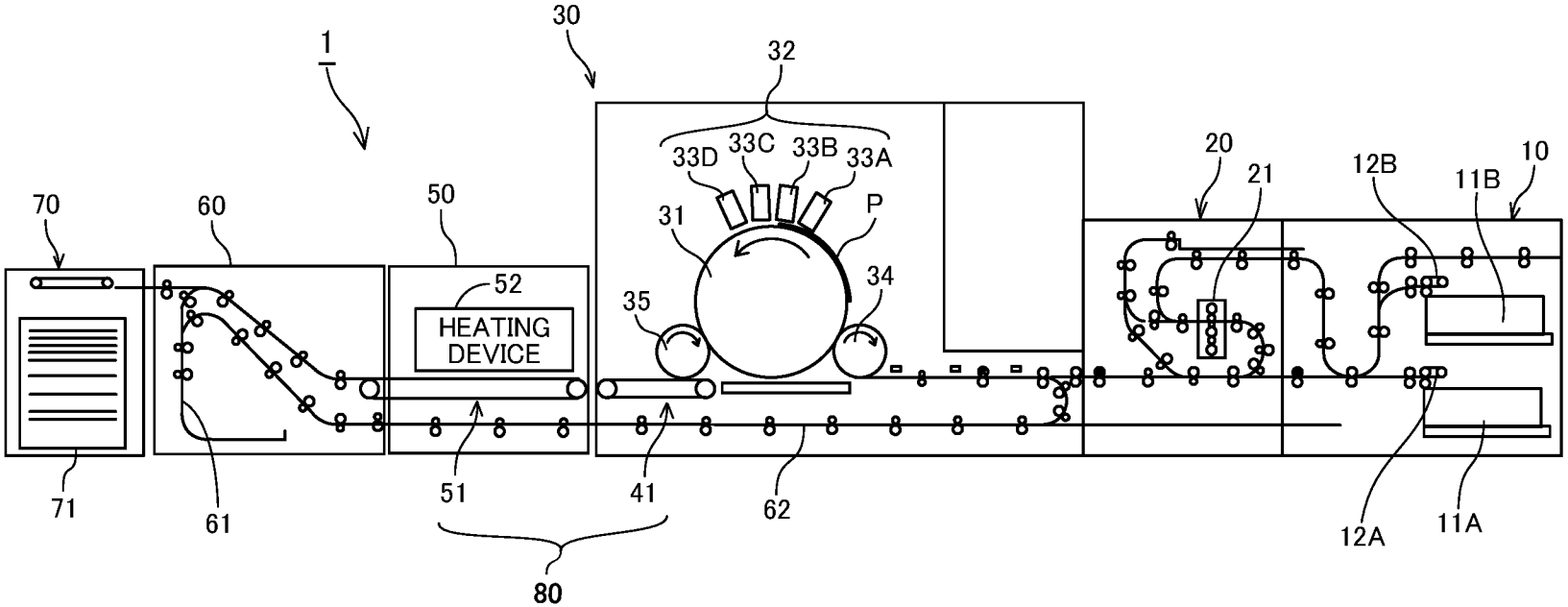
FIG. 1 is a schematic cross-sectional side view of a printer as a liquid discharge apparatus according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and all of the components or elements described in the embodiments of this disclosure are not necessarily indispensable. As used herein, the singular forms "a", "an", and "the" are intended to include the plural forms as well, unless the context clearly indicates otherwise.

Referring now to the drawings, wherein like reference numerals designate identical or corresponding parts throughout the several views, embodiments of the present disclosure are described below. A printer as a liquid discharge apparatus according to a first embodiment of the present disclosure is described with reference to FIGS. 1 and 2.

FIG. 1 is a schematic side view of the printer 1 according to the first embodiment.

Figure 2:
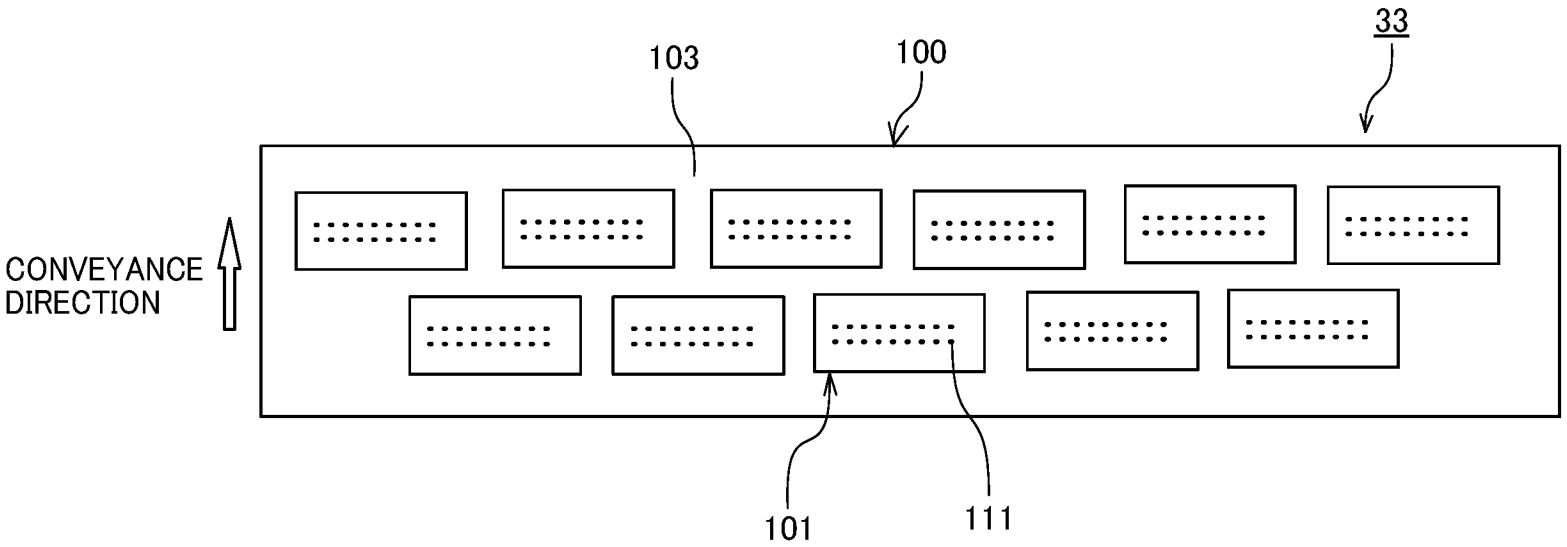
FIG. 2 is a plan view of a discharge unit of the printer.

FIG. 2 is a schematic plan view of a discharge unit of the printer 1.

The printer 1 according to the first embodiment includes a loading unit 10 to load a sheet P into the printer 1, a pretreatment unit 20 as an applier, a printing unit 30, a dryer 50, a reverse mechanism 60, and an ejection unit 70.

In the printer 1, the pretreatment unit 20 applies, as required, a pretreatment liquid as an application liquid onto the sheet P fed (supplied) from the loading unit 10, the printing unit 30 applies a desired liquid onto the sheet P to perform required printing.

After the printer 1 dries the liquid adhering to the sheet P by the dryer 50, the printer 1 ejects the sheet P to the ejection unit 70 without printing on a back surface of the sheet P through the reverse mechanism 60. The printer 1 may print on both sides of the sheet P via the reverse mechanism 60 after the printer 1 dries the liquid adhering to the sheet P by the dryer 50, and the printer 1 then ejects the sheet P to the ejection unit 70.

The loading unit 10 includes loading trays 11 (a lower loading tray 11A and an upper loading tray 11B) to accommodate a plurality of sheets P and feeding devices 12 (a feeding device 12A and a feeding device 12B) to separate and feed the sheets P one by one from the loading trays 11 and supplies the sheets P to the pretreatment unit 20.

The pretreatment unit 20 includes, e.g., a coater 21 as a treatment-liquid application unit that applies a treatment liquid onto the sheet P to coat a printing surface of the sheet P with the treatment liquid having an effect of aggregation of ink particles to prevent bleed-through.

The printing unit 30 includes a drum 31 and a liquid discharge device 32. The drum 31 is a bearer (rotating member) that bears the sheet P on a circumferential surface of the drum 31 and rotates. The liquid discharge device 32 discharges liquids toward the sheet P borne on the drum 31.

The printing unit 30 includes transfer cylinders 34 and 35. The transfer cylinder 34 receives the sheet P fed from the pretreatment unit 20 and forwards the sheet P to the drum 31. The transfer cylinder 35 receives the sheet P conveyed by the drum 31 and forwards the sheet P to a second conveyor 41.

The transfer cylinder 34 includes a sheet gripper to grip a leading end of the sheet P conveyed from the pretreatment unit 20 to the printing unit 30. The sheet P thus gripped by the transfer cylinder 34 is conveyed as the transfer cylinder 34 rotates. The transfer cylinder 34 forwards the sheet P to the drum 31 at a position opposite (facing) the drum 31.

Similarly, the drum 31 includes a sheet gripper on a surface of the drum 31, and the leading end of the sheet P is gripped by the sheet gripper of the drum 31. The drum 31 includes a plurality of suction holes dispersed on a surface of the drum 31, and a suction unit generates suction airflows directed from desired suction holes of the drum 31 to an interior of the drum 31.

The sheet gripper of the drum 31 grips the leading end of the sheet P forwarded from the transfer cylinder 34 to the drum 31, and the sheet P is attracted to and borne on the drum 31 by the suction airflows by the suction device. As the drum 31 rotates, the sheet P is conveyed.

The liquid discharge device 32 includes discharge units 33 (discharge units 33A to 33D) to discharge liquids onto the sheet P as a liquid application device. For example, the discharge unit 33A discharges a liquid of cyan (C), the discharge unit 33B discharges a liquid of magenta (M), the discharge unit 33C discharges a liquid of yellow (Y), and the discharge unit 33D discharges a liquid of black (K). Further, a discharge unit may discharge a special liquid, that is, a liquid of spot color such as white, gold, or silver.

As illustrated in FIG. 2, for example, each of the discharge unit 33 includes a head module 100 including a full line head. The head module 100 includes a plurality of liquid discharge heads 101 arranged in a staggered manner on a base 103. Each of the liquid discharge heads 101 includes a plurality of nozzle rows, and a plurality of nozzles 111 is arranged in each of the nozzle rows. Hereinafter, the "liquid discharge head 101" is simply referred to as a "head 101".

The printing unit 30 controls a discharge operation of each discharge unit 33 of the liquid discharge device 32 by a drive signal corresponding to print data. When the sheet P borne on the drum 31 passes through a region facing the liquid discharge device 32, the liquids of respective colors are discharged from the discharge units 33 toward the sheet P, and an image corresponding to the print data is formed on the sheet P.

The drum 31 forwards the sheet P to which a liquid is applied by the liquid discharge device 32 to the transfer cylinder 35. The transfer cylinder 35 forwards the sheet P fed from the drum 31 to the second conveyor 41. The sheet is conveyed from the second conveyor 41 to the dryer 50 (heater).

The dryer 50 serving as a dryer includes a heating device 52. The dryer 50 heats and dries the sheet P, on which the liquid is applied, while conveying the sheet P fed from the second conveyor 41 by the first conveyor 51.

The reverse mechanism 60 includes a reverse part 61 and a duplex conveyor 62. The reverse mechanism 60 reverses the sheet P that has passed through the dryer 50 to dry a first surface of the sheet P onto which the liquid is applied when the printer 1 performs a duplex printing. The duplex conveyor 62 feeds the reversed sheet P back upstream from the transfer cylinder 34 of the printing unit 30. The reverse part 61 reverses the sheet P by switchback manner.

The ejection unit 70 includes an ejection tray 71 on which a plurality of sheets P is stacked. The plurality of sheets P conveyed from the reverse mechanism 60 is sequentially stacked and held on the ejection tray 71.

In the present embodiment, an example in which the sheet is a cut sheet is described. However, embodiments of the present disclosure can also be applied to an apparatus using a continuous medium (web) such as continuous paper or roll paper, an apparatus using a sheet material such as wallpaper, and the like.

A sheet heater 500 according to a first embodiment of the present disclosure is described with reference to FIGS. 3 and 4. The sheet heater 500 includes a sheet conveyor 80 to convey the sheet P according to the first embodiment of the present disclosure.

Figure 3:
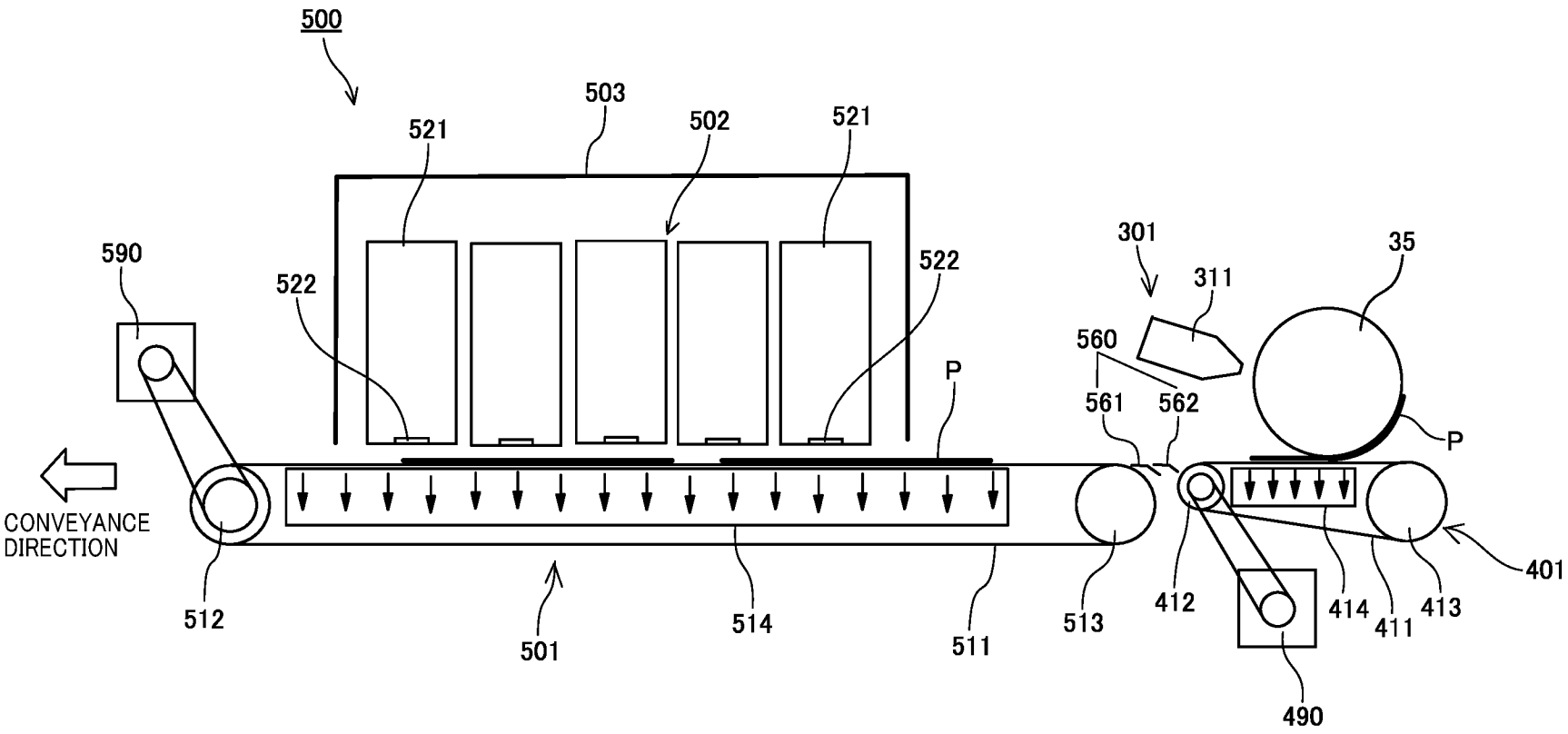
FIG. 3 is a schematic cross-sectional side view of a sheet heater according to a first embodiment of the present disclosure.

FIG. 3 is a schematic cross-sectional side view of the sheet heater 500 according to the first embodiment of the present disclosure.

Figure 4:
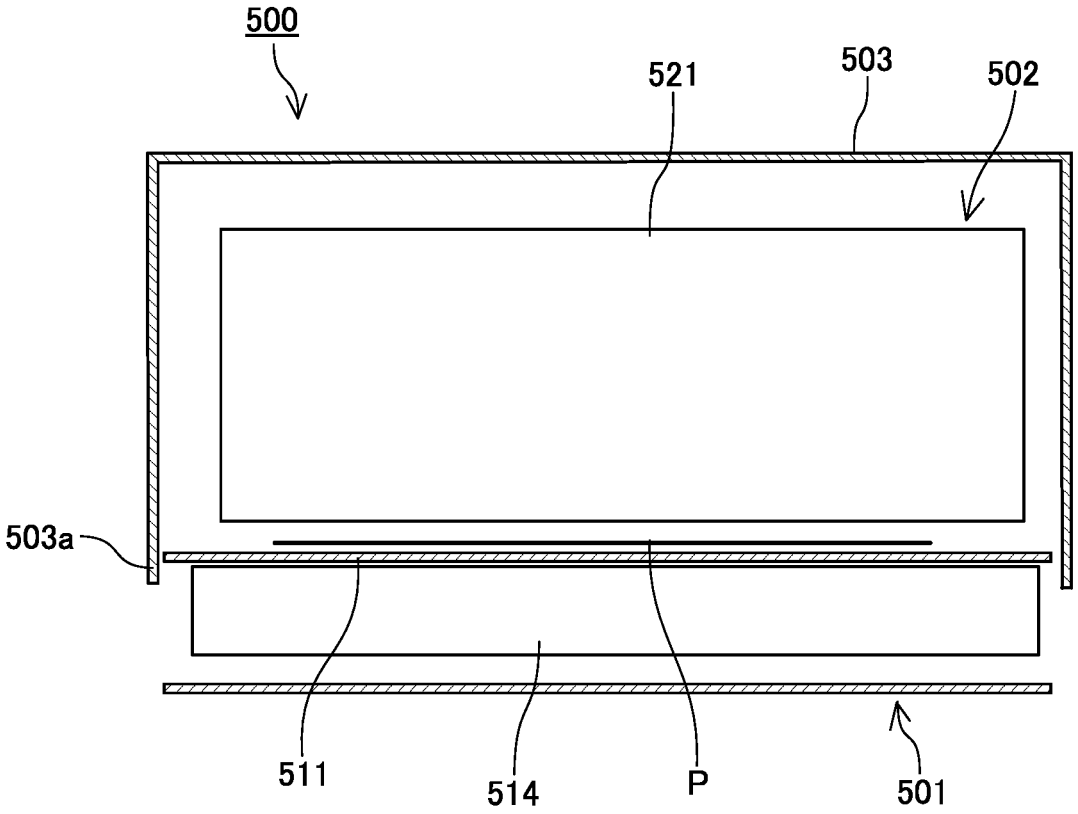
FIG. 4 is a schematic cross-sectional front view of the sheet heater of FIG. 3.

FIG. 4 is a schematic cross-sectional front view of the sheet heater 500 according to the first embodiment of the present disclosure.

The sheet heater 500 includes a first conveyance mechanism 501, a heating unit 502, a second conveyance mechanism 401, and a preheater 301. The first conveyance mechanism 501 serves as the first conveyor 51 (see FIG. 1). The heating unit 502 also serves as the heating device 52 (see FIG. 1). The second conveyance mechanism 401 serves as the second conveyor 41 (see FIG. 1).

Thus, the sheet heater 500 includes parts of the dryer 50 such as the heating device 52 and the first conveyor 51 and parts of the printing unit 30 such as the transfer cylinder 35 and the second conveyor 41. The first conveyor 51 and the second conveyor 41 configure a sheet conveyor 80 (see FIG. 1) in embodiments as described below.

The first conveyance mechanism 501 includes a first conveyance belt 511 that bears and conveys the sheet P. The conveyance belt 511 is an endless conveyor. The first conveyance belt 511 is an endless belt stretched between a drive roller 512 as a drive rotator and a driven roller 513 as a driven rotator. The conveyance belt 511 orbits and rotates to move the sheet P. The drive roller 512 is rotationally driven by, e.g., a drive motor 590 via a timing belt.

The first conveyance belt 511 is a belt that includes a plurality of openings from which air is sucked by a suction chamber 514 arranged inside the first conveyance belt 511.

The suction chamber 514 serves as a suction mechanism. The first conveyance belt 511 may be, for example, a mesh belt, a plain weave belt having a suction hole, or the like. The suction chamber 514 includes a suction blower, a fan, or the like to suck the air through the plurality of openings in the first conveyance belt 511 to attract the sheet P to the first conveyance belt 511. The conveyor (first conveyance belt 511) is not limited to the conveyor that uses suction method to attract and convey the sheet P as described above. The conveyor may attract and convey the sheet P on the conveyor by, for example, an electrostatic adsorption method or a gripping method using a gripper.

The heating unit 502 includes a plurality of ultraviolet irradiators 521 disposed in a housing 503 along a "conveyance direction" of the sheet P as indicated by arrow in FIG. 3. The ultraviolet irradiators 521 irradiate the sheet P conveyed by the first conveyance belt 511 of the first conveyance mechanism 501 with ultraviolet rays to heat the sheet P.

The ultraviolet irradiator 521 includes granular ultraviolet light emitting diode elements 522 (UV-LED elements) arranged in a grid pattern on an irradiation surface of the ultraviolet irradiator 521. Since the UV-LED elements 522 emit light at an identical illuminance, the ultraviolet irradiator 521 uniformly emits light along the irradiation surface as a whole.

As a wavelength of the ultraviolet light (UV light), a wavelength having a peak wavelength of 395 nm and a wavelength distribution having a full width at half maximum of about 15 nm is used. However, the wavelength and wavelength distribution of the ultraviolet light (UV light) is not limited the wavelength as described above and may be any other wavelength.

As illustrated in FIG. 3, the housing 503 is arranged to have a gap with the conveyance belt 511 in a vertical direction, and the gap is formed along the conveyance direction of the sheet P. As illustrated in FIG. 4, the housing 503 includes an extension portion 503*a* extended lower than conveyance belt 511 in a vertical (height) direction perpendicular to the conveyance direction of the sheet P.

The second conveyance mechanism 401 is disposed upstream from the first conveyance belt 511.

The second conveyance mechanism 401 includes a second conveyance belt 411 that bears and conveys the sheet P. The second conveyance belt 411 is an endless conveyor. The second conveyance belt 411 is stretched between a drive roller 412 and a driven roller 413. The conveyance belt 511 orbits and rotates to move the sheet P. The drive roller 412 is rotationally driven by, e.g., a drive motor 490 via a timing belt.

The second conveyance belt 411 is a belt that includes a plurality of openings from which air is sucked by a suction chamber 414 disposed inside the second conveyance belt 411. The second conveyance belt 411 may be, for example, a mesh belt, a plain weave belt having a suction hole, or the like. The suction chamber 414 includes a suction blower, a fan, or the like to suck the air through the plurality of openings in the second conveyance belt 411 to attract the sheet P to the second conveyance belt 411. The conveyor (second conveyance belt 411) is not limited to the conveyor that uses suction method to attract and convey the sheet P as described above. The conveyor may attract and convey the sheet P on the conveyor by, for example, an electrostatic adsorption method or a gripping method using a gripper.

The sheet heater 500 includes a guide 560 between the second conveyance belt 411 and the first conveyance belt 511. The guide 560 serves as a guide to guide the sheet P from the second conveyance belt 411 to the first conveyance belt 511.

The sheet heater 500 includes a preheater 301 that heats at least one of the sheet P and the transfer cylinder 35 before the sheet P, onto which the liquid has been applied, is conveyed from the transfer cylinder 35 to the second conveyance belt 411.

The preheater 301 is a non-contact heater to heat the sheet P in a non-contact manner. The preheater 301 includes an air blower 311 to blow warm air toward the transfer cylinder 35.

The preheater 301 dries the sheet P until the pigment contained in the liquid applied to the sheet P does not move, and the transfer cylinder 35 forwards the dried sheet P to the second conveyance belt 411 in the sheet heater 500 according to the first embodiment.

Since no heat source is disposed around the second conveyance belt 411, the sheet P forwarded to the second conveyance belt 411 is conveyed in a normal temperature environment.

Since the temperature of the second conveyance belt 411 is reduced (lower than the temperature of the first conveyance belt 511), the sheet heater 500 can reduce the movement of the pigment in the liquid (ink) on the sheet P and can also reduce an occurrence of cockling of the sheet P. The movement of the pigment in the ink (liquid) occurs when the sheet P contacting a high-temperature portion of the second conveyance belt 411.

Then, the guide 560 guides the sheet P conveyed from the second conveyance belt 411 to the first conveyance belt 511. The ultraviolet irradiator 521 irradiates the sheet P conveyed by the first conveyance belt 511 with ultraviolet rays to heat the liquid (ink) on the sheet P. Thus, the liquid (ink) on the sheet P is heated by the ultraviolet irradiator 521 and dried to the final image quality.

The heating unit 502 is not limited to the ultraviolet irradiator 521. The heating unit 502 may be other heating units such as an infrared irradiator or an air blower.

Next, a specific configuration of the guide 560 is described below in detail with reference to FIG. 5.

Figure 5:
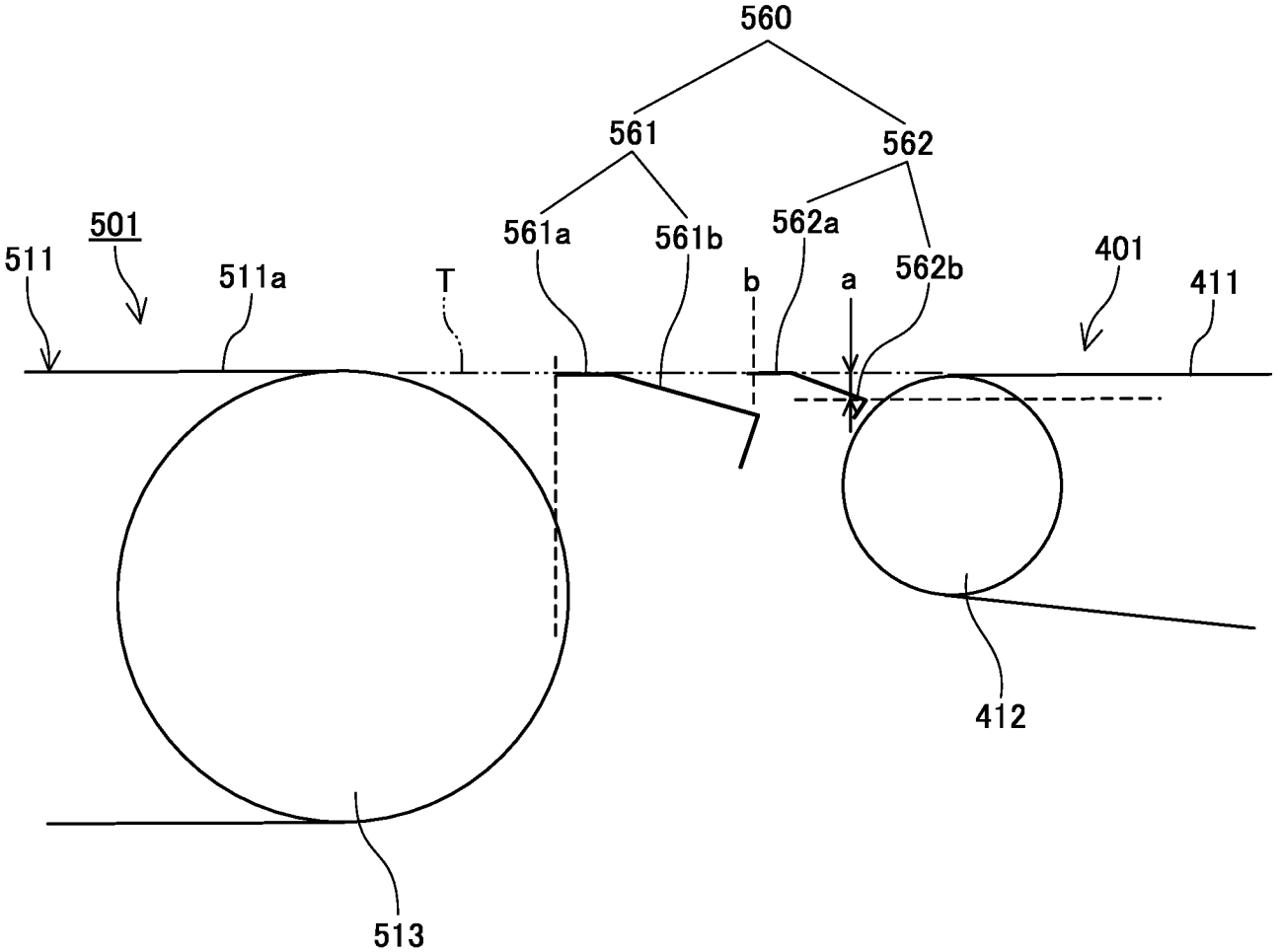
FIG. 5 is a side view of a main portion of the sheet heater according to the first embodiment illustrating a guide 560.

FIG. 5 is a side view of a main portion of the guide 560.

The guide 560 includes a first guide 561 and a second guide 562. The first guide 561 is disposed upstream of the driven roller 513 of the first conveyance belt 511 and downstream of the second conveyance belt 411. The first guide 561 guides the sheet P to the first conveyance belt 511. The second guide 562 is disposed upstream of the first guide 561. The second guide 562 receives the sheet P from the second conveyance belt 411 and guides the sheet P to the first guide 561.

The second guide 562 is disposed downstream of the second conveyance belt 411. Both sides of the second guide 562 crossing the conveyance direction are fixed by side plates. The second guide 562 receives the sheet P fed from the second conveyance belt 411 and guides the sheet P to the first guide 561.

The second guide 562 includes an inclined portion 562*b* and a second guide portion 562*a*. The inclined portion 562*b* serves as a first guide portion and is inclined upward from an upstream end of the inclined portion 562*b* toward a downstream end of the inclined portion 562*b* in the conveyance direction. The second guide portion 562*a* is horizontally aligned and is disposed downstream of the inclined portion 562*b*.

An upstream end of the inclined portion 562*b* of the second guide 562 is lower than a conveyance path T indicated by an imaginary line by a distance "a" as illustrated in FIG. 5. Thus, even if a leading end of the sheet P moves along an outer periphery of the drive roller 412, the inclined portion 562*b* of the second guide 562 can scoop up the leading end of the sheet P.

The first guide 561 is disposed downstream of the second guide 562 and upstream of the first conveyance belt 511. The first guide 561 guides the sheet P from the second guide 562 to the first conveyance belt 511.

A downstream end of the second guide 562 in the conveyance direction (second guide portion 562*a*) is disposed directly (immediately) above an upstream end of the inclined portion 561*b* of the first guide 561 in the conveyance direction as indicated by a broken line "b". Thus, the first guide 561 can smoothly receive the sheet P fed from the second guide portion 562*a* of the second guide 562.

The first guide 561 receives the sheet P conveyed along the second guide 562 and guides the sheet P to the first conveyance belt 511. The first guide 561 includes an inclined portion 561*b* and a second guide portion 561*a*. The second guide portion 561*a* is also referred to as a "downstream end portion".

The inclined portion 561*b* serves as a first guide portion and is inclined upward from an upstream end of the inclined portion 561*b* toward a downstream end of the inclined portion 561*b* in the conveyance direction. The second guide portion 561*a* is horizontally aligned and is disposed downstream of the inclined portion 561*b* in the conveyance direction.

As described above, the downstream end of the second guide portion 562*a* of the second guide 562 in the conveyance direction is disposed immediately above the upstream end of the inclined portion 561*b* of the first guide 561 in the conveyance direction as illustrated by the broken line "b" in FIG. 5.

Therefore, even if the leading end of the sheet P having passed through the second guide 562 hangs down, the sheet P can be reliably received by the inclined portion 561*b* of the first guide 561.

A direction of the second guide portion 561*a* of the first guide 561 is substantially the same as a direction of a belt surface 511*a* of the first conveyance belt 511. Thus, posture of the leading end of the sheet P becomes along the belt surface 511*a* so that the first guide 561 can prevent the sheet P from fluttering on the first conveyance belt 511 when the sheet P lands on the belt surface 511*a* of the first conveyance belt 511. The belt surface 511*a* is also referred to as a "conveyance surface".

In this way, the guide 560 can restrict an area in which the sheet P does not partially contact the belt surface 511*a* of the first conveyance belt 511. Thus, the guide 560 can reduce waving (cockling) of the sheet P due to a difference in drying property of the liquid (ink) on the sheet P.

The sheet heater 500 according to the first embodiment includes the first guide 561 that is horizontally movable in a direction parallel to the belt surface 511*a* of the first conveyance belt 511. The first guide 561 can adjust a distance (interval) between the first guide 561 and the driven roller 513 of the first conveyance mechanism 501. The first conveyance belt 511 is wound around the drive roller 512 and the driven roller 513.

Thus, the first guide 561 can appropriately adjust the distance between the first conveyance belt 511 and the first guide 561 to prevent paper jam of the sheet P. Thus, the first guide 561 can reduce occurrence of paper jam of the sheet P guided from the first guide 561 toward the first conveyance belt 511.

A change in a distance between the first conveyance belt 511 and the first guide 561 according to a tension adjustment of the first conveyance belt 511 is described below with reference to FIG. 6.

Figure 6:
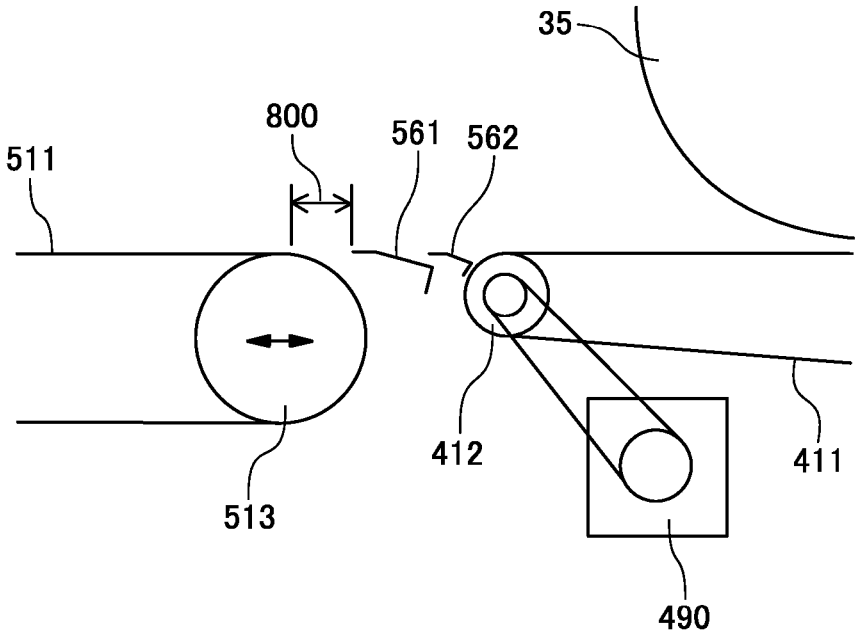
FIG. 6 is a schematic side view of a portion of the sheet heater illustrating a change in an interval between a first conveyance belt and a first guide due to a tension adjustment of the first conveyance belt.

FIG. 6 is an enlarged partial schematic side view of the sheet heater 500.

The driven roller 513 is movable in a direction as indicated by arrow in FIG. 6 to change the distance between the drive roller 512 and the driven roller 513 so that the driven roller 513 can adjust tension of the first conveyance belt 511 (belt tension). Here, when the circumferential length of the first conveyance belt 511 is long, a fluctuation of the distance between the drive roller 512 and the driven roller 513 due to the belt tension of the first conveyance belt 511 increases. Thus, when a belt unit is attached to a frame of the sheet heater 500, a center position of the driven roller 513 varies.

The belt unit includes the first conveyance belt 511, the drive roller 512, the driven roller 513, and the like to form a single body of the belt unit of the first conveyance mechanism 501.

At this time, when the driven roller 513 is moved, the distance between the driven roller 513 and the first guide 561 changes, and the distance between the first conveyance belt 511 and the first guide 561 changes.

When the distance between the driven roller 513 and the first guide 561 increases, the sheet P may enter a gap 800 formed between the first guide 561 and the first conveyance belt 511, and a jam occurs.

Conversely, when the distance between the driven roller 513 and the first guide 561 is narrow, the first conveyance belt 511 and the first guide 561 may interfere with each other during adjusting the tension of the first conveyance belt 511.

Therefore, the sheet heater 500 according to the first embodiment includes the first guide 561 having an adjustable position in the conveyance direction. Thus, the position of the first guide 561 is variable in the conveyance direction. Thus, the sheet heater 500 can maintain the gap 800 between the first guide 561 and the first conveyance belt 511 at a desired distance to prevent the occurrence of the jam.

Next, a mechanism for adjusting the belt tension (tension adjustment mechanism) and a mechanism for adjusting a position of the first guide (position adjustment mechanism) in the first embodiment are described with reference to FIGS. 7 and 8.

Figure 7:
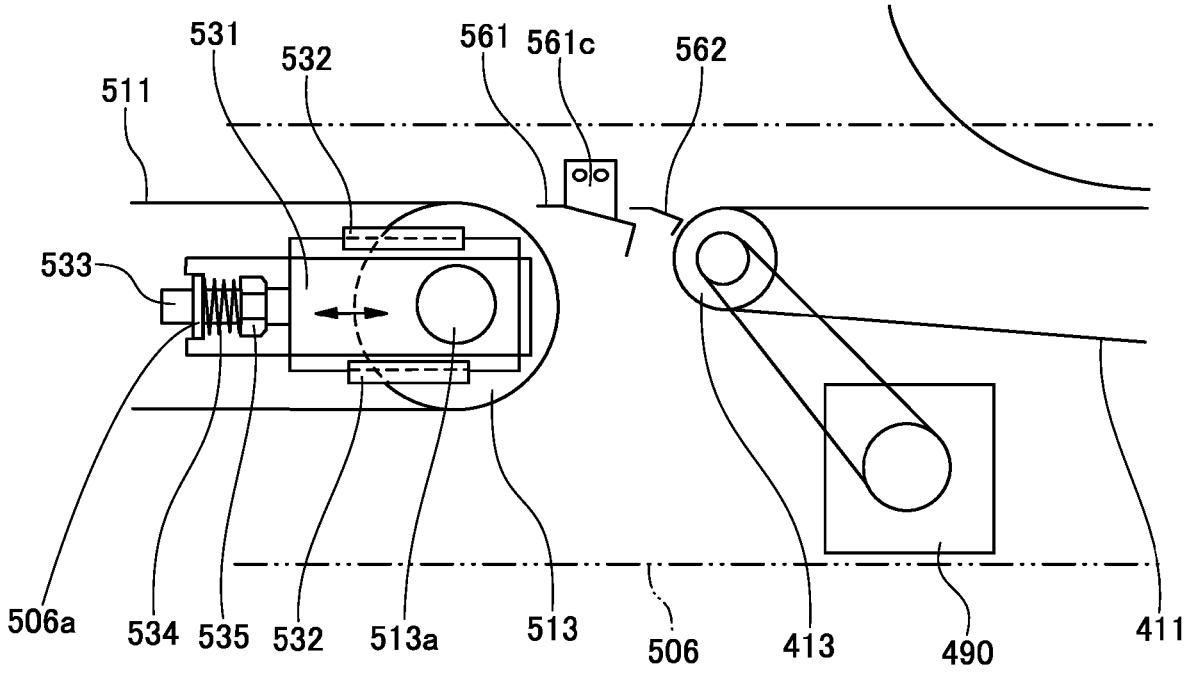
FIG. 7 is an enlarged partial schematic side view of a tension adjustment mechanism to adjust a belt tension and a position adjustment mechanism to adjust a position of the first guide according to the first embodiment.

FIG. 7 is an enlarged partial schematic side view of the tension adjustment mechanism and the position adjustment mechanism in the first embodiment.

Figure 8:
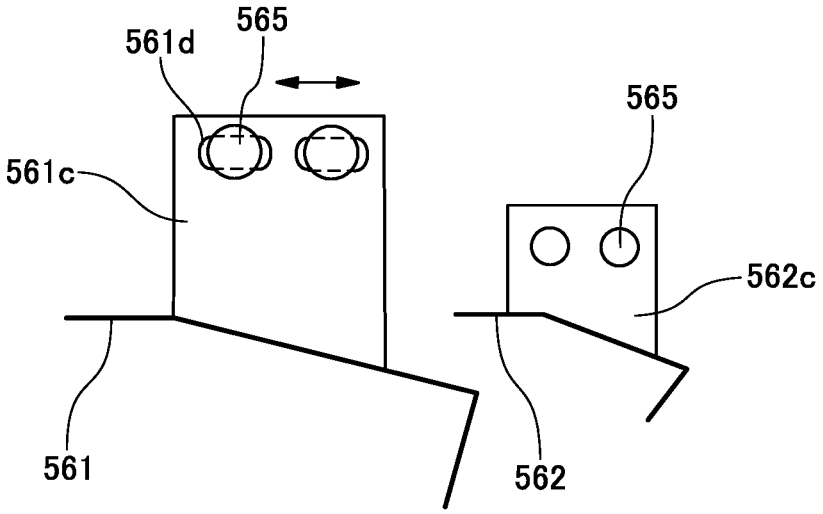
FIG. 8 is an enlarged partial schematic side view of the guide.

FIG. 8 is an enlarged partial schematic side view of the sheet heater 500.

The tension adjustment mechanism adjusts the belt tension of the first conveyance belt 511. The tension adjustment mechanism includes tension plates 531 to hold both ends of an axis 513*a* of the driven roller 513. The tension plates 531 are held so that the tension plates 531 are movable in the horizontal direction (conveyance direction) along two guide rails 532 as indicated by arrow in FIG. 7. The guide rails 532 are fixed to the frame 506.

A screw 533 is fixed to a left end (drive roller 512 side) of the tension plate 531. A compression coil spring 534 is interposed between a nut 535 screwed on the screw 533 and a fix portion 506*a* of the frame 506.

The nut 535 is rotated to expand or contract the compression coil spring 534 to move the tension plate 531 and the driven roller 513. Thus, the distance between the drive roller 512 and the driven roller 513 changes to adjust the belt tension of the first conveyance belt 511.

The first guide 561 includes flanges 561*c* at both ends in a longitudinal direction of the first guide 561 of the driven roller 513. The longitudinal direction of the first guide 561 is parallel to a longitudinal direction of the axis 513*a* and is also parallel to a direction perpendicular to a paper surface of FIG. 7.

The flange 561*c* includes long holes 561*d* longer in the conveyance direction indicated by arrow in FIG. 8. The conveyance direction is parallel to a movable direction of the driven roller 513. Therefore, the first guide 561 is changeable and adjustable the position of the first guide 561 in the conveyance direction.

While the flange 561*c* of the first guide 561 faces an inner surface of the frame 506, the screw 565 is inserted into the long hole 561*d* of the flange 561*c*. Thus, the first guide 561 is fastened to the frame 506 at a predetermined position to fix the first guide 561 to the frame 506.

Thus, the first guide 561 changes the position of the first guide 561 in the conveyance direction according to the position of the driven roller 513. Thus, the first guide 561 can appropriately maintain the gap 800 between the first conveyance belt 511 and the first guide 561 so that the first guide 561 can prevent the occurrence of paper jam of the sheet P.

Figure 9:
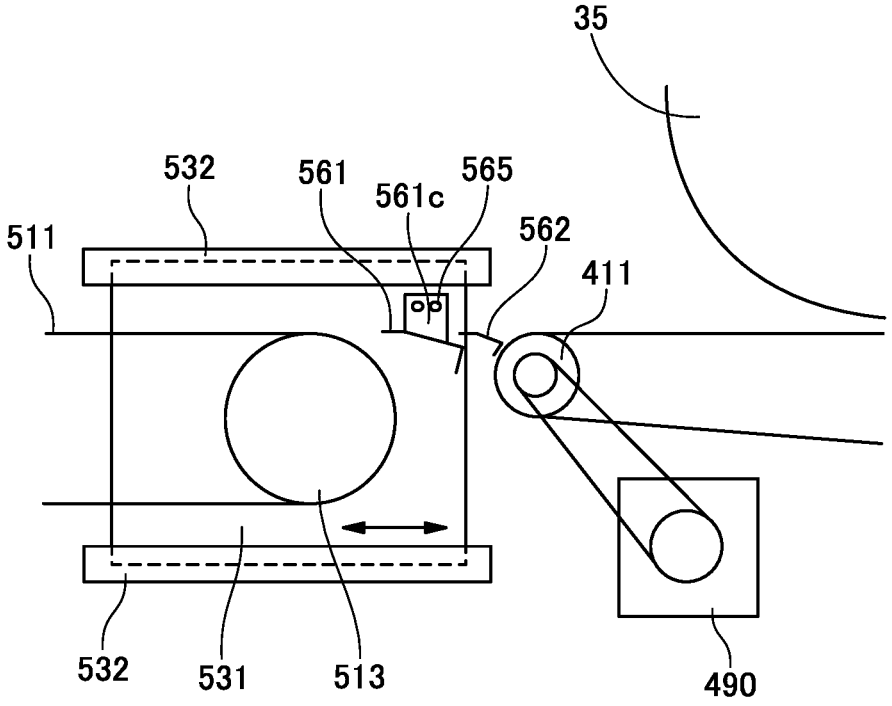
FIG. 9 is an enlarged partial schematic side view of the tension adjustment mechanism to adjust the belt tension and the position adjustment mechanism to adjust the position of the first guide according to a second embodiment of the present disclosure.

A sheet heater 500 according to a second embodiment of the present disclosure is described with reference to FIG. 9. FIG. 9 is a schematic side view of the tension adjustment mechanism to adjust the belt tension and the position adjustment mechanism to adjust the position of the first guide 561 according to the second embodiment.

In the second embodiment, the driven roller 513 of the first conveyance belt 511 and the first guide 561 are attached to the tension plate 531 as described in the first embodiment.

The first guide 561 is fastened and fixed to the tension plate 531 by inserting screws 565 into holes (not limited to long holes 561*d*) in the flanges 561*c* at both ends in the longitudinal direction of the first guide 561. The longitudinal direction of the first guide 561 is parallel to a longitudinal direction of the axis 513*a* of the driven roller 513 (see FIG. 7) and is also parallel to a direction perpendicular to a paper surface of FIG. 9.

The first guide 561 is attached to the tension plate 531 at a position (attachment position) at which the distance between the first conveyance belt 511 and the first guide 561 becomes a predetermined (constant) distance. The first conveyance belt 511 is wound around the drive roller 512 and the driven roller 513. Thus, the distance between the first guide 561 and the driven roller 513 is constant.

With such a configuration of the first guide 561, the tension plate 531 is moved in the conveyance direction to adjust the belt tension of the first conveyance belt 511. At the time of adjusting the belt tension, a positional relation between the driven roller 513 and the first guide 561 does not change since the driven roller 513 and the first guide 561 are fixed to the tension plate 531. Accordingly, the sheet heater 500 according to the second embodiment can reduce occurrence of the paper jam of the sheet P.

In the sheet heater 500 according to the second embodiment, the belt surface 511*a* of the first conveyance belt 511 may be heated by heating unit 502 or by contacting the sheet P heated the heating unit 502, and the belt surface 511*a* may thermally expand. In this case of thermal expansion of the belt surface 511*a* as well, the positional relationship between the driven roller 513 and the first guide 561 does not change. Thus, the sheet heater 500 can appropriately maintain the distance between the first conveyance belt 511 and the first guide 561.

The sheet heater 500 according to a third embodiment according to the present disclosure is described with reference to FIG. 10.

Figure 10:
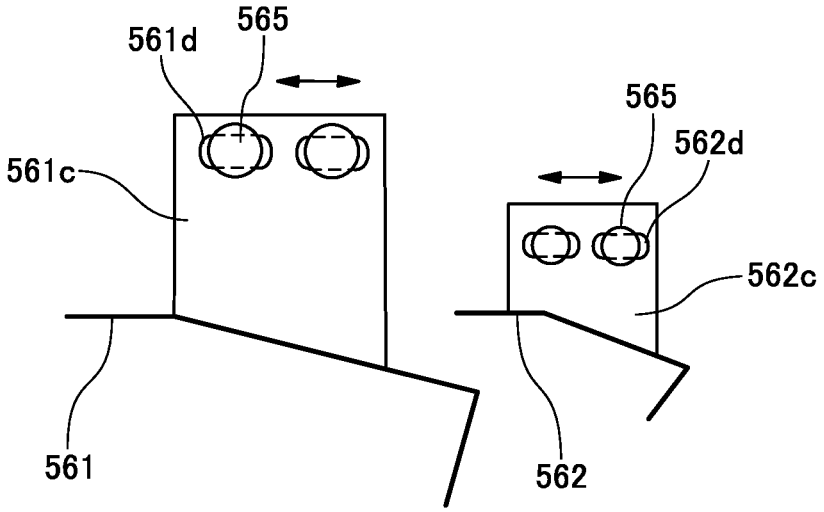
FIG. 10 is a schematic side view of the guide according to a third embodiment of the present disclosure.

FIG. 10 is a schematic side view of the guide 560 according to the third embodiment.

The sheet heater 500 according to the third embodiment includes the second guide 562, a position of which is also adjustable in the conveyance direction together with the first guide 561.

In the same manner as described above, the first guide 561 includes long holes 561*d* in the flanges 561*c* at both ends of the first guide 561 in the longitudinal direction of the first guide 561. The long holes 561*d* are longer in the conveyance direction as indicated by arrow in FIG. 10.

The longitudinal direction of the first guide 561 is parallel to a direction perpendicular to a paper surface of FIG. 10. The first guide 561 is fixed to the frame 506 or the like by screws 565 respectively inserted through the long holes 561*d* of the first guide 561.

Similarly, the second guide 562 includes long holes 562*d* in the flange 562*c* at both ends of the second guide 562 in the longitudinal direction of the second guide 562. The long holes 562*d* are longer in the conveyance direction as indicated by arrow in FIG. 10.

The longitudinal direction of the second guide 562 is parallel to a direction perpendicular to a paper surface of FIG. 10. The second guide 562 is also fixed to the frame 506 or the like by screws 565 respectively inserted through the long holes 562*d* of the second guide 562.

Thus, when the position of the first guide 561 is adjusted, the positional relation between the first guide 561 and the second guide 562 can also be adjusted.

Next, the sheet heater 500 according to a fourth embodiment of the present disclosure is described with reference to FIG. 11.

Figure 11:
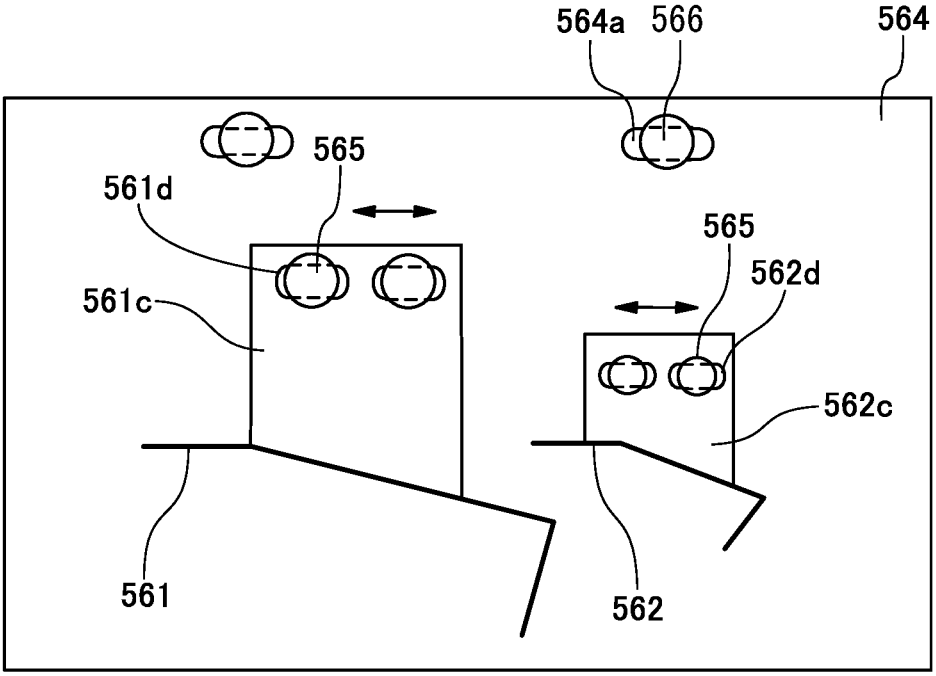
FIG. 11 is a schematic side view of the guide according to a fourth embodiment of the present disclosure.

FIG. 11 is a schematic side view of the guide 560 according to the fourth embodiment.

The sheet heater 500 according to the fourth embodiment includes the second guide 562, a position of which is also adjustable in the conveyance direction together with the first guide 561.

The first guide 561 includes long holes 561*d* in the flanges 561*c* at both ends of the first guide 561 in the longitudinal direction of the first guide 561. The long holes 561*d* are longer in the conveyance direction as indicated by arrow in FIG. 11.

The longitudinal direction of the first guide 561 is parallel to a direction perpendicular to the paper surface of FIG. 11. The first guide 561 is fixed to an intermediate frame 564 or the like by screws 565 respectively inserted through the long holes 561*d* of the first guide 561.

Similarly, the second guide 562 includes long holes 562*d* in the flange 562*c* at both ends of the second guide 562 in the longitudinal direction of the second guide 562. The long holes 562*d* are longer in the conveyance direction as indicated by arrow in FIG. 11.

The longitudinal direction of the second guide 562 is parallel to a direction perpendicular to a paper surface of FIG. 10. The second guide 562 is fixed to an intermediate frame 564 or the like by screws 565 respectively inserted through the long holes 562*d* of the second guide 562.

Thus, the intermediate frame 564 can adjust the positional relation between the first guide 561 and the second guide 562.

The intermediate frame 564 includes long holes 564*a* and is fixed to the frame 506 of the sheet heater 500 by screws 566 inserted through the long holes 564*a*. The long holes

564*a* are also referred to as "frame long holes 564*a*". The screws 566 are also referred to as "frame screws 566". The long holes 564*a* (frame long holes) are longer in the conveyance direction as indicated by arrow in FIG. 11.

Thus, a position of the intermediate frame 564 is adjusted to adjust a position of the first guide 561 in the conveyance direction. Thus, the sheet heater 500 according to the fourth embodiment can reduce occurrence of the paper jam of the sheet P.

Next, the sheet heater 500 according to a fifth embodiment of the present disclosure is described with reference to FIG. 12.

Figure 12:
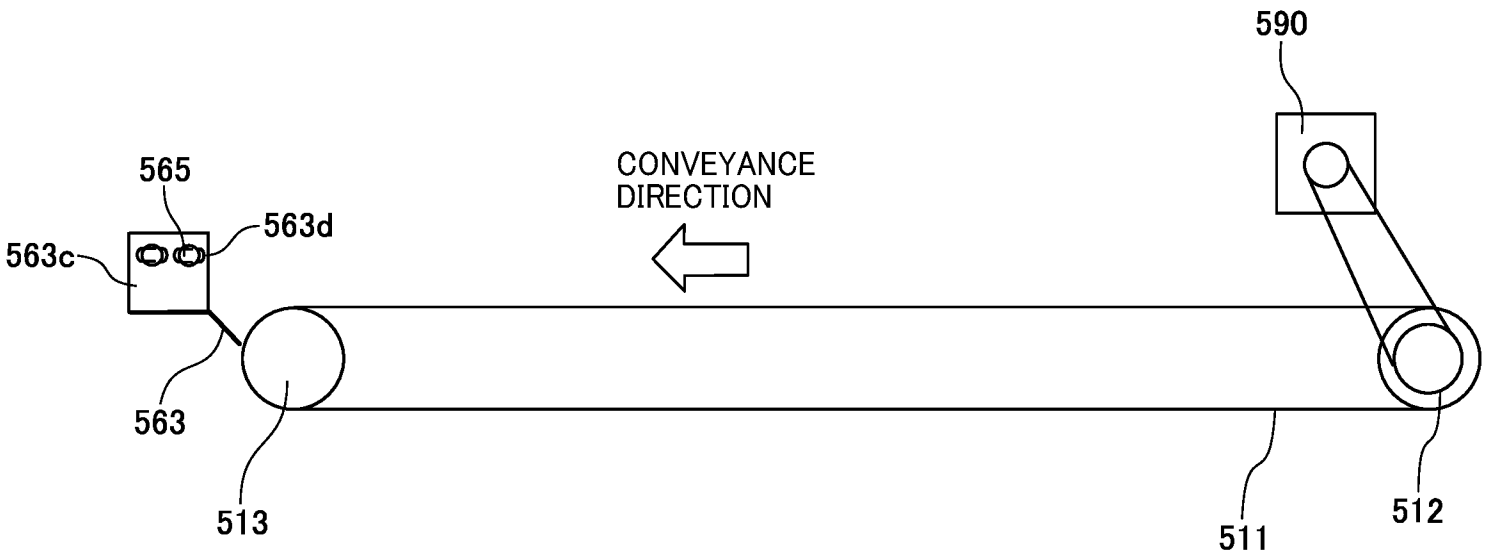
FIG. 12 is a schematic side view of the first conveyance belt according to a fifth embodiment of the present disclosure.

FIG. 12 is a schematic side view of the sheet heater 500 according to the fifth embodiment of the present disclosure.

The sheet heater 500 according to the fifth embodiment includes the first conveyance belt 511 wound around the drive roller 512 and the driven roller 513. The drive roller 512 is disposed upstream end (right end in FIG. 12) of the first conveyance belt 511, and the driven roller 513 is disposed downstream end (left end in FIG. 12) of the first conveyance belt 511.

The sheet heater 500 includes a third guide 563 disposed downstream end (left end in FIG. 12) of the first conveyance belt 511. The third guide 563 receives the sheet P conveyed from the first conveyance belt 511. The third guide 563 is also referred to a "downstream guide".

Similarly, to the first guide 561 described in each of the above-described embodiments, the third guide 563 is disposed so that a position of the third guide 563 is adjustable in the conveyance direction.

Thus, the third guide 563 can reduce occurrence of paper jam of the sheet P guided from the first conveyance belt 511 toward the third guide 563.

In the present embodiments, a "liquid" discharged from the head is not particularly limited as long as the liquid has a viscosity and surface tension of degrees dischargeable from the head.

Preferably, the viscosity of the liquid is not greater than 30 mPa·s under ordinary temperature and ordinary pressure or by heating or cooling.

Examples of the liquid include a solution, a suspension, or an emulsion that contains, for example, a solvent, such as water or an organic solvent, a colorant, such as dye or pigment, a functional material, such as a polymerizable compound, a resin, or a surfactant, a biocompatible material, such as DNA, amino acid, protein, or calcium, or an edible material, such as a natural colorant.

Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

Further, the water-based pigment ink is not limited to the above-mentioned embodiments and may contain an ultraviolet polymerization initiator and an ultraviolet polymerizable compound.

In this case, the water-based pigment ink preferably contains the ultraviolet polymerization initiator and the ultraviolet polymerizable, content of which does not cause or hardly cause curing due to a polymerization reaction even when the heater irradiates the water-based pigment ink with light.

Specifically, the content of the ultraviolet polymerization initiator in an ink composition is less than 0.1% by mass, or the content of the ultraviolet polymerizable compound in the ink composition is less than 5% by mass.

Such a configuration of the water-based pigment ink can reduce a running cost and obtain a printed matter having good safety.

The ultraviolet polymerizable compound may be a monomer or an oligomer.

Examples of the ultraviolet polymerizable compound include methacrylic acid.

Examples of an energy source to generate energy to discharge liquid include a piezoelectric actuator (a laminated piezoelectric element or a thin-film piezoelectric element), a thermal actuator that employs a thermoelectric conversion element, such as a heating resistor, and an electrostatic actuator including a diaphragm and opposed electrodes.

Examples of the "liquid discharge apparatus" include, not only apparatuses capable of discharging liquid to materials onto which liquid can adhere, but also apparatuses to discharge a liquid toward gas or into a liquid.

The "liquid discharge apparatus" may include devices to feed, convey, and eject the material on which liquid can adhere.

The liquid discharge apparatus may further include a pretreatment apparatus to coat a treatment liquid onto the material, and a post-treatment apparatus to coat a treatment liquid onto the material, onto which the liquid has been discharged.

The "liquid discharge apparatus" may be, for example, an image forming apparatus to form an image on a sheet by discharging ink.

The "liquid discharge apparatus" is not limited to an apparatus to discharge liquid to visualize meaningful images, such as letters or figures.

For example, the "liquid discharge apparatus" may be an apparatus to form arbitrary images, such as arbitrary patterns, or fabricate three-dimensional images. The above-described term "material on which liquid can adhere" represents a material on which liquid is at least temporarily adhered, a material on which liquid is adhered and fixed, or a material into which liquid is adhered to permeate.

Examples of the "material on which liquid can adhere" include recording media such as a paper sheet, recording paper, and a recording sheet of paper, film, and cloth, electronic components such as an electronic substrate and a piezoelectric element, and media such as a powder layer, an organ model, and a testing cell.

The "material onto which liquid can adhere" includes any material on which liquid adheres unless particularly limited.

Examples of the "material to which liquid can adhere" include any materials to which liquid can adhere even temporarily, such as paper, thread, fiber, fabric, leather, metal, plastic, glass, wood, and ceramic.

The "liquid discharge apparatus" may be an apparatus to relatively move the head and a material on which liquid can adhere.

However, the liquid discharge apparatus is not limited to such an apparatus.

For example, the liquid discharge apparatus may be a serial head apparatus that moves the head or a line head apparatus that does not move the head.

Examples of the "liquid discharge apparatus" further include a treatment liquid coating apparatus to discharge a treatment liquid to a sheet to coat the treatment liquid on a sheet surface to reform the sheet surface, and an injection granulation apparatus in which a composition liquid including raw materials dispersed in a solution is injected through nozzles to granulate fine particles of the raw materials.

The terms "image formation", "recording", "printing", "image printing", and "fabricating" used in the present embodiments may be used synonymously with each other.

Numerous additional modifications and variations are possible in light of the above teachings. It is therefore to be understood that, within the scope of the above teachings, the present disclosure may be practiced otherwise than as specifically described herein. With some embodiments having thus been described, it is obvious that the same may be varied in many ways. Such variations are not to be regarded as a departure from the scope of the present disclosure and appended claims, and all such modifications are intended to be included within the scope of the present disclosure and appended claims.

What is claimed is:

1. A sheet conveyor comprising:

a conveyance belt configured to rotate to convey a sheet on which a liquid has been applied in a conveyance direction;

a guide configured to guide the sheet to the conveyance belt, a position of the guide being variable in the conveyance direction;

wherein the guide includes:

an inclined portion inclined upward from an upstream end toward a downstream end in the conveyance direction, wherein the upstream end of the inclined portion is lower than a conveyance path of the sheet; and a guide portion disposed downstream of the inclined portion in the conveyance direction and aligned horizontally; and another guide disposed upstream of the guide in the conveyance direction, and configured to guide the sheet to the guide;

wherein said another guide includes:

another inclined portion inclined upward from an upstream end toward a downstream end in the conveyance direction, wherein the upstream end of said another inclined portion is lower than the conveyance path of the sheet; and another guide portion disposed downstream of said another inclined portion in the conveyance direction and aligned horizontally.

2. The sheet conveyor according to claim 1, wherein a position of said another guide is variable in the conveyance direction.

3. The sheet conveyor according to claim 1, wherein the downstream end of said another guide in the conveyance direction is disposed directly above the upstream end of the guide.

4. The sheet conveyor according to claim 1, further comprising:

another conveyance belt disposed upstream of said another guide in the conveyance direction, and configured to convey the sheet to said another guide, wherein the upstream end of said another guide in the conveyance direction is lower than a conveyance surface of said another conveyance belt along which the sheet is conveyed.

5. The sheet conveyor according to claim 1, further comprising a drive roller configured to rotate the conveyance belt; and a driven roller configured to be driven by a rotation of the conveyance belt, wherein the conveyance belt is wound around the drive roller and the driven roller, the driven roller is movable in the conveyance direction, and the guide is movable together with the driven roller in the conveyance direction.

6. The sheet conveyor according to claim 1, wherein the guide portion of the guide is along a conveyance surface of the conveyance belt along which the sheet is conveyed.

7. The sheet conveyor according to claim 1, further comprising:

a frame, wherein the guide includes a flange having a long hole longer in the conveyance direction, and the guide is fixed to the frame with a screw inserted into the long hole.

8. The sheet conveyor according to claim 5, further comprising:

a tension plate, wherein the guide and the driven roller are fixed to the tension plate.

9. The sheet conveyor according to claim 1, further comprising:

a frame, wherein the guide includes a first flange having a first long hole longer in the conveyance direction, the guide is fixed to the frame with a first screw inserted into the first long hole of the guide, said another guide includes a second flange having a second long hole longer in the conveyance direction, and said another guide is fixed to the frame with a second screw inserted into the second long hole of said another guide.

10. The sheet conveyor according to claim 1, further comprising:

a frame; and an intermediate frame having a frame long hole longer in the conveyance direction, the intermediate frame fixed to the frame with a frame screw inserted through the frame long hole, wherein the guide includes a first flange having a first long hole longer in the conveyance direction, the guide is fixed to the intermediate frame with a first screw inserted into the first long hole of the guide, said another guide includes a second flange having a second long hole longer in the conveyance direction, and said another guide is fixed to the intermediate frame with a second screw inserted into the second long hole of said another guide.

11. The sheet conveyor according to claim 1, wherein the guide portion of the guide and said another guide portion of said another guide are aligned along the conveyance path.

12. A sheet heater comprising:

the sheet conveyor according to claim 1; and a heater configured to heat the sheet conveyed by the conveyance belt.

13. A liquid discharge apparatus comprising:

a liquid application device configured to apply the liquid onto the sheet; and the sheet heater according to claim 12.

14. A printer comprising:

a liquid application device configured to apply the liquid onto the sheet; and the sheet heater according to claim 12.

15. A sheet conveyor comprising:

a conveyance belt configured to rotate to convey a sheet on which a liquid has been applied in a conveyance direction;

a first guide disposed downstream of the conveyance belt;

wherein the first guide includes:

a first inclined portion inclined upward from an upstream end toward a downstream end in the conveyance direction, wherein the upstream end of the first inclined portion is lower than a conveyance path of the sheet; and a first guide portion disposed downstream of the first inclined portion in the conveyance direction and aligned horizontally; and a second guide disposed downstream of the first guide;

wherein the second guide includes:

a second inclined portion inclined upward from an upstream end toward a downstream end in the conveyance direction, wherein the upstream end of the second inclined portion is lower than the conveyance path; and a second guide portion disposed downstream of the second inclined portion in the conveyance direction and aligned horizontally.

16. The sheet conveyor according to claim 15, wherein a position of at least one of the first guide and the second guide are variable in the conveyance direction.

17. The sheet conveyor according to claim 15, wherein the second guide portion of the second guide is along a conveyance surface of another conveyance belt downstream from the second guide.

18. The sheet conveyor according to claim 15, wherein the upstream end of the second guide is disposed directly below the downstream end of the first guide.

19. A sheet heater comprising:

the sheet conveyor according to claim 17; and a heater configured to heat the sheet conveyed by said another conveyance belt.

20. A sheet conveyor comprising:

a first guide and a second guide configured to convey a sheet between a first conveyance belt and a second conveyance belt;

wherein the first guide is configured to receive the sheet from the first conveyance belt, and includes:

a first inclined portion inclined upward from an upstream end toward a downstream end in the conveyance direction, wherein the upstream end of the first inclined portion is lower than a conveyance path of the sheet; and a first guide portion disposed downstream of the first inclined portion in the conveyance direction;

wherein the second guide is disposed downstream from the first guide in the conveyance direction, and configured to guide the sheet to the second conveyance belt;

wherein the second guide includes:

a second inclined portion inclined upward from an upstream end toward a downstream end in the conveyance direction, wherein the upstream end of the second inclined portion is disposed directly below the downstream end of the first guide; and a second guide portion disposed downstream of the second inclined portion in the conveyance direction, the second guide portion is along a conveyance surface of the second conveyance belt.

* * * * *